US006523229B2

(12) United States Patent
Severson

(10) Patent No.: US 6,523,229 B2
(45) Date of Patent: Feb. 25, 2003

(54) CORD KEEPER STRAP

(76) Inventor: Timothy Lee Severson, P.O. Box 97, North Plains, OR (US) 97133

( * ) Notice: Subject to any disclaimer, the term of this patent is extended or adjusted under 35 U.S.C. 154(b) by 0 days.

(21) Appl. No.: 09/819,127

(22) Filed: Mar. 27, 2001

(65) Prior Publication Data

US 2002/0170149 A1 Nov. 21, 2002

(51) Int. Cl.[7] ..... B65D 63/10
(52) U.S. Cl. ..... 24/16 PB
(58) Field of Search ..... 24/16 R, 16 PB, 24/17 AP, 30.5 R, 30.5 P, 17 A; 248/74.3; 439/369–371

(56) References Cited

U.S. PATENT DOCUMENTS 535,502 A * 3/1895 Knighton ..... 24/16 R
2,373,328 A * 4/1945 Morehouse ..... 174/135
2,870,502 A * 1/1959 Sasse ..... 24/17 A
2,971,231 A * 2/1961 Stoddart ..... 206/397
3,006,048 A * 10/1961 Windish
3,197,830 A * 8/1965 Hoadley ..... 24/16 PB
3,501,814 A * 3/1970 Anderson et al. ..... 24/16 PB
3,576,054 A 4/1971 Rynk
3,601,863 A * 8/1971 Dorsey ..... 24/16 PB
3,835,505 A * 9/1974 Shewbridge ..... 24/16 R
4,182,005 A * 1/1980 Harrington ..... 24/16 PB
4,690,476 A 9/1987 Morgenrath
4,780,935 A * 11/1988 Palombit ..... 24/16 PB
4,910,835 A 3/1990 Carpenter
5,024,402 A 6/1991 Hamel
5,048,158 A 9/1991 Koerner
5,104,335 A 4/1992 Conley et al.
5,168,603 A 12/1992 Reed
5,402,971 A * 4/1995 Bower ..... 248/74.3
5,581,850 A * 12/1996 Acker ..... 24/16 PB
5,732,445 A 3/1998 Stodolka et al.
5,802,676 A 9/1998 Tolan
6,073,315 A * 6/2000 Rasmussen ..... 24/16 PB
6,401,305 B1 * 6/2002 Joseph ..... 24/16 R

* cited by examiner

*Primary Examiner*—James R. Brittain

(57) ABSTRACT

A cord keeper strap is disclosed herein having an elongated flexible strap with resilient elastic properties and a plurality of holes along its longitudinal axis. Through employment of a selected hole a cincture can be made about a cord. Other selected holes may be employed by a button fastener to secure male to female plug ends on electrical cords, or to secure bundled or coiled articles for storage.

3 Claims, 2 Drawing Sheets

CORD KEEPER STRAP

CROSS-REFERENCE TO RELATED APPLICATIONS

Not applicable.

BACKGROUND

1. Field of Invention

This invention relates to flexible band retainers; specifically, a means to keep electrical cords coiled or bundled up, and a means to secure male to female connections.

2. Description of Prior Art

In the past, attempts have been made to provide a means to keep or secure coiled or bundled electrical cord. U.S. Pat. No. 5,802,676 discloses a strap, which secures a bundled cord using hook latch material. However, this fastener is rendered ineffectual when it collects dirt and debris. U.S. Pat. No. 5,024,402 to Hamel, another strap type device, is for use exclusively on small tools and appliances. U.S. Pat. No. 4,182,005 reveals another strap type cord keeper with a cumbersome mechanism to cinch up the strap. A need has long existed to provide a simple cord keeper.

A need has also existed for a means to keep secure the connection of male to female plug ends on electrical cords. Many contemporary patents that address this problem suffer from deficiencies and disadvantages. A keeper should have high retentive properties without requiring excessive accuracy of location. Some keepers heretofore known are very complicated for such a simple task. Many of these could cause damage to the electrical cord resulting in electrical short. A keeper should be made of nonconductive material as to be effectively insulated electrically.

Examples of contemporary keepers which present some of the above mentioned problems are disclosed in U.S. Pat. Nos. 4,690,476; 5,104,335; and 5,732,445.

SUMMARY OF INVENTION

In accordance with the present invention a cord keeper strap comprises a strap with elastic properties, a plurality of holes along the longitudinal axis thereof, and a button fastener.

OBJECTS AND ADVANTAGES

Accordingly, several objects and advantages of the present invention:

(a) to provide a simpler keeper that can be easily attached to a single strand of electrical cord;

(b) to provide a keeper that by means of its resilient elastic character can be stretched around bundled or coiled strands of electrical cord, rope, hoses or the like, thereby securing said article for storage;

(c) to provide a keeper which can be used to secure the connection between male and female plug ends on electrical cords;

(d) to provide a keeper suitable for securing unwanted slack in electrical cords on household appliances, and;

(e) to provide a keeper suitable for securing the bundled cord of a small tool or appliance to said article.

DRAWING FIGURES

In the drawings a closely related figure has the same number and an alphabetic suffix.

REFERENCE NUMERALS IN DRAWINGS

| | | | |
|---|---|---|---|
| 10 | cord keeper strap | 12 | round hole |
| 14 | cross shaped hole | 16 | slotted hole |
| 18 | billet end of strap | 20 | head of button fastener |
| 22 | circular flange | 24 | base of button fastener |
| 26 | shank of button fastener | 28 | electrical cord |
| 32 | male electrical cord plug | 34 | female electrical cord plug |
| 36 | tool (drill motor) | | |

DESCRIPTION OF THE PREFERRED EMBODIMENT

Figure 1:
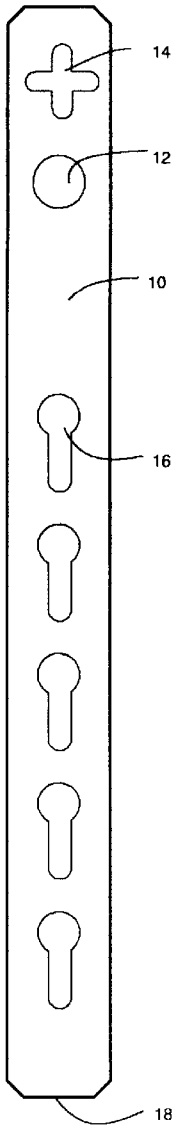
FIG. 1 is a plan view of a cord keeper strap.
Figure 2:
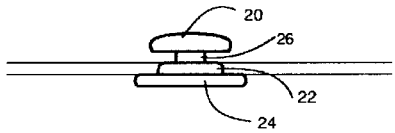
FIG. 2 is a side elevation view of a button fastener.
Figure 2A:
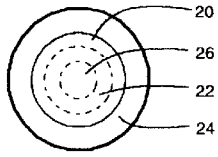
FIG. 2A is a plan view of a button fastener.

A preferred embodiment of the present invention the cord keeper strap is illustrated in FIG. 1. The strap 8 is composed of a flexible and elastic material, preferably, fabricated from a suitable grade of rubber or plastic, to achieve the desired elasticity. The strap 8 has a plurality of holes aligned along the longitudinal axis. Round hole 12 is designed to accept the button fastener as illustrated in FIG. 2. Head 20 and shank 26 can be forcibly inserted through hole 12 by means of the strap material surrounding the hole yielding to the thrust of insertion. The base 24 comes to rest against said strap while circular flange 22 is seated in hole 12. The diameter of circular flange 22 is slightly greater than the diameter of hole 12 to ensure a proper seating abutment.

Figure 3:
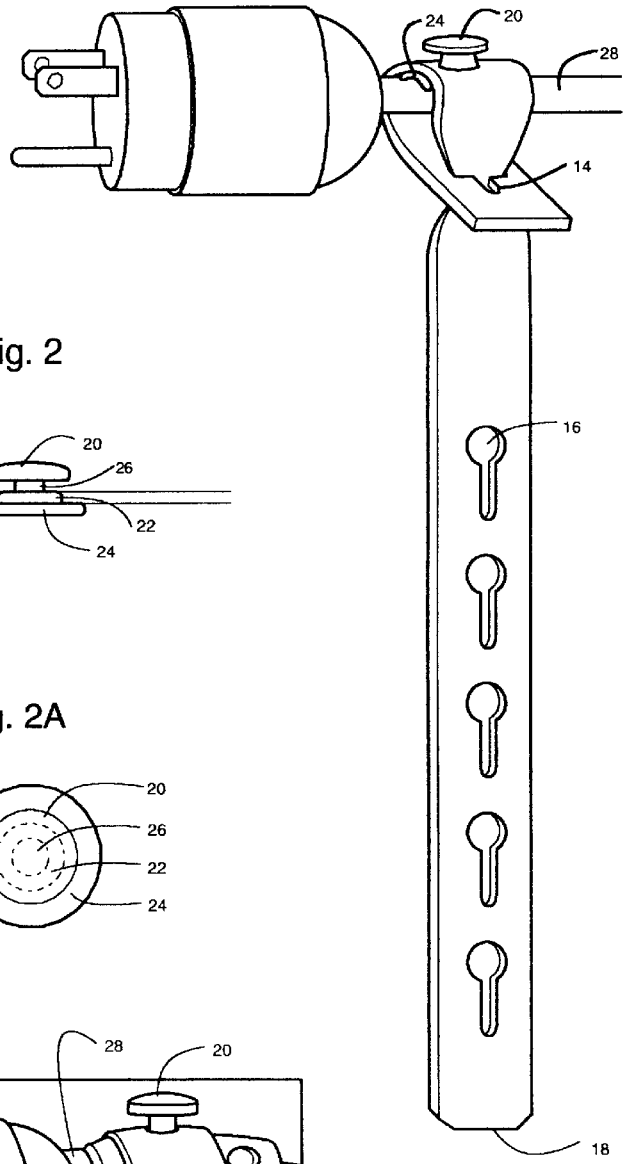
FIG. 3 is a perspective view showing a cord keeper strap attached to a typical electrical cord.

As illustrated in FIG. 3, while base 24 rests against cord 28, cross shaped hole end of strap is wound part way around cord 28. billet end 18 is passed through cross shaped hole 14 thus forming a first loop about cord 28. Furthermore, since the composition of the strap is substantially elastic, flexible and resilient, by stretching and pulling a tight cincture can be made about cord 28.

Figure 4:
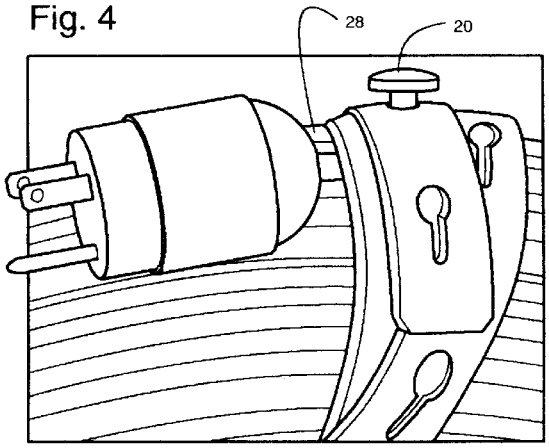
FIG. 4 is a perspective view showing a cord keeper strap in a typical application securing a coiled electrical cord.

As illustrated in FIG. 4, once a cincture has been made and strap 10 is attached to cord 28, the remainder of cord 28 can be stretchably wrapped around the whole of cord 28. After wrapping strap 10 one or more times around said coiled cord 28, forming a second loop, select an appropriate slotted hole 16 as to provide a tight cincture, and pull said hole over head 20. Allow the elastic properties of the strap to pull the slotted end of hole 16 against shank 26 completing a cincture and securing cord 28 for storage.

Figure 5:
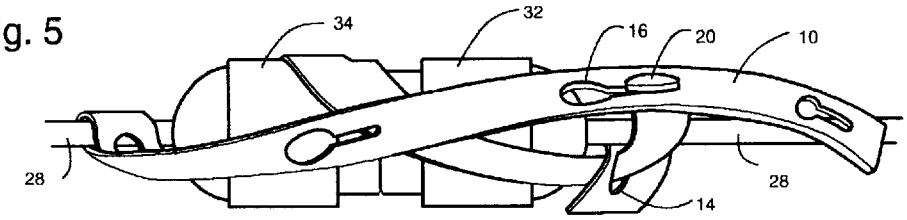
FIG. 5 is a perspective view of a cord keeper strap securing the male to female connection of electrical cords.

FIG. 5 illustrates another application of the present invention. While strap 10 is already affixed to the male end 32 of an electrical cord, and the male end 32 to female end 34 connection is made with another cord, it is desirable to keep that connection secure. Strap 10 can be stretchably wrapped around and over female plug end 34 and accompanying cord 28 one or more times, configuration is determined by the size and shape of said plug ends 32 and 34. Select an appropriate hole 16 and by pulling it over button head 20, as described above, said male to female connection will be held secure.

Figure 6:
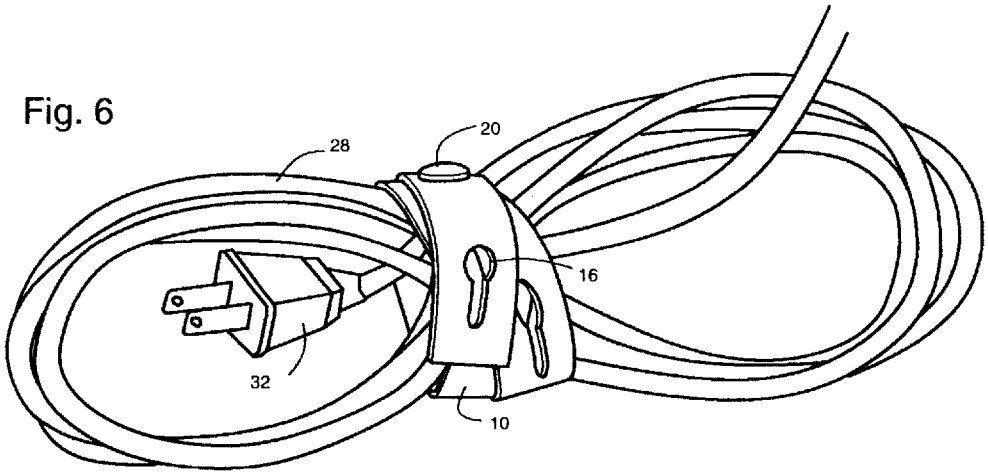
FIG. 6 is a perspective view of a cord keeper strap securing a bundled electrical cord.

FIG. 6 illustrates another embodiment of the present invention. The cord keeper strap can be wholly smaller yet proportionately the same. In this embodiment the base 24 and flange 22 may be molded as part of strap 10 leaving only shank 26 and head 20 outwardly exposed. In this application a bundled electrical cord 28 can be secured by using the same method as described for FIG. 4. Since cincture to any electrical cord is not restricted by excessive accuracy of location the same method of securing can be used on a bundle of slack anywhere on the length of said electrical cord.

Figure 7:
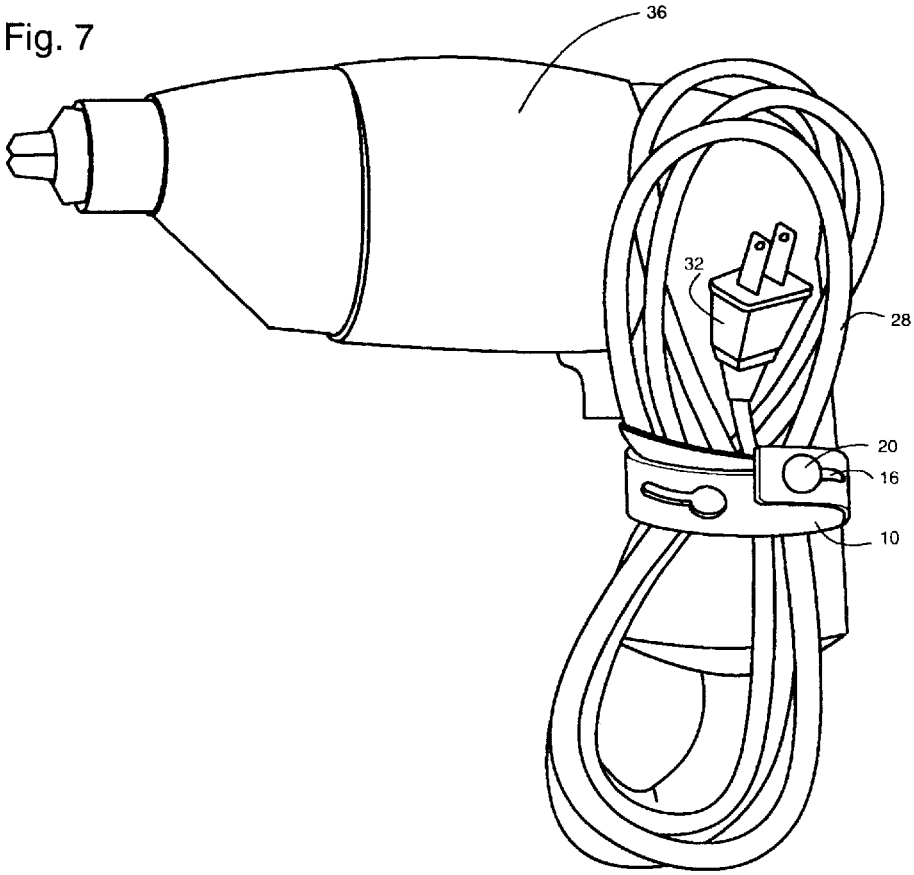
FIG. 7 is a perspective view of a cord keeper strap securing a bundled cord to a tool.

FIG. 7 illustrates another application of the present invention. A bundled electrical cord 28 with affixed cord keeper strap 10 can be secured to its host tool 36 or small appliance. While holding said bundled cord 28 against a suitable part of tool 36, the strap 10 is stretchably wrapped around both cord 28 and the suitable part of tool 36. Select a proper hole 16 and pull it over button head 20. The tool and cord are now ready for storage.

In view of the forgoing, it can be seen that the present invention provides an improved cord keeper. By means of its resilient elastic character the cord keeper strap is an effective and useful tool for securing electrical cords and like articles in many applications.

While particular embodiments of the present invention have been shown and described some changes and modifications may be made without departing from the broader aspects of the present invention. Therefore, it is the aim of the appended claims to cover all such embodiments.

What is claimed is:

1. A strap for securing a first article to a second article comprising:

(a) an elongated strap with elastic properties, having a first end, a billet end and a longitudinal axis;

(b) a cross shaped hole proximate the first end adapted to pass the billet end through to form a first loop about the first article becoming affixed thereto;

(c) a round hole adjacent to the cross shaped hole toward the billet end, having a button fastener therein extending away from the strap, and (d) a predetermined number of slotted holes formed in the strap and aligned along the remainder of the longitudinal axis thereof, adapted to capture said button fastener when a second loop is formed about the second article thereby securing the first and second article together.

2. The invention described in claim 1 wherein said cross shaped hole having right angle dimensions is aligned on and perpendicular to the longitudinal axis thereof.

3. The invention described in claim 1 wherein said slotted holes are of keyhole shape, geometrically spaced, with elongated slotted portion positioned toward the billet end and coinciding with the longitudinal axis thereof.

* * * * *